US006328431B1

(12) United States Patent
Silverbrook

(10) Patent No.: US 6,328,431 B1
(45) **Date of Patent: *Dec. 11, 2001**

(54) SEAL IN A MICRO ELECTRO-MECHANICAL DEVICE

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/575,138

(22) Filed: May 23, 2000

(30) Foreign Application Priority Data

Jun. 30, 1999 (AU) ..... PQ1308

(51) Int. Cl.[7] ..... B41J 2/05
(52) U.S. Cl. ..... 347/65
(58) Field of Search ..... 347/65, 63, 56, 347/54, 20, 68; 60/528, 529

(56) References Cited

U.S. PATENT DOCUMENTS

| | | | | |
|---|---|---|---|---|
| 3,680,887 | * | 8/1972 | Docker | 280/686 |
| 4,581,624 | * | 4/1986 | O'Connor | 251/129.06 |
| 4,770,740 | * | 9/1988 | Tsuzuki et al. | 347/54 |
| 4,850,315 | * | 7/1989 | Mallas | 123/90.61 |
| 5,058,856 | * | 10/1991 | Gordon et al. | 251/11 |
| 5,149,517 | * | 9/1992 | Fain et al. | 423/447.2 |
| 5,378,504 | | 1/1995 | Bayard et al. . | |
| 5,905,517 | | 5/1999 | Silverbrook . | |
| 5,943,075 | | 8/1999 | Lee et al. . | |
| 6,019,457 | | 2/2000 | Silverbrook . | |
| 6,044,646 | | 4/2000 | Silverbrook . | |
| 6,196,667 | * | 3/2001 | Hiroki et al. | 347/65 |

FOREIGN PATENT DOCUMENTS

| | | | | |
|---|---|---|---|---|
| 0 947 325 A1 | | 10/1999 | (EP) . | |
| 2-30543-A | * | 1/1990 | (JP) | B41J/2/45 |
| 4-1051-A | * | 1/1992 | (JP) | B41J/2/45 |
| WO95/03179 | | 2/1995 | (WO) . | |

* cited by examiner

*Primary Examiner*—John Barlow
*Assistant Examiner*—Robert D Loper

(57) ABSTRACT

A micro electro-mechanical device embodied within an ink ejection nozzle having an actuating arm that is caused to move an ink displacing paddle when heat inducing electric current is passed through the actuating arm is disclosed. The paddle is located in an ink chamber and the actuating arm passes through an actuator aperture in the chamber. The chamber is partly defined by a cylindrical part circular concave edge portion on an upper wall of the ink chamber. The actuating arm carries a second cylindrical wall which covers the actuator aperture and which registers in the part circular concave edge portion. The second cylindrical wall is moveable relative to the edge portion when the actuating arm and paddle are moved to eject a droplet. Upon movement of the actuating arm the second wall moves relative to the edge portion and a meniscus is created between the edge portion and the second wall which forms a seal between the second wall and the edge portion of the chamber wall.

11 Claims, 4 Drawing Sheets

SEAL IN A MICRO ELECTRO-MECHANICAL DEVICE

CO-PENDING APPLICATIONS

Various methods, systems and apparatus relating to the present invention are disclosed in the following co-pending applications filed by the applicant or assignee of the present invention simultaneously with the present application:

| | | | | |
|---|---|---|---|---|
| 09/575,197 | 09/575,195 | 09/575,159 | 09/575,132 | 09/575,123 |
| 09/575,148 | 09/575,130 | 09/575,165 | 09/575,153 | 09/575,118 |
| 09/575,131 | 09/575,116 | 09/575,144 | 09/575,139 | 09/575,186 |
| 09/575,185 | 09/575,191 | 09/575,145 | 09/575,192 | 09/575,181 |
| 09/575,193 | 9/575,156 | 09/575,183 | 09/575,160 | 09/575,150 |
| 09/575,169 | 09/575,184 | 09/575,128 | 09/575,180 | 09/575,149 |
| 09/575,179 | 09/575,133 | 09/575,143 | 09/575,187 | 09/575,155 |
| 09/575,196 | 09/575,198 | 09/575,178 | 09/575,164 | 09/575,146 |
| 09/575,174 | 09/575,163 | 09/575,168 | 09/575,154 | 09/575,129 |
| 09/575,124 | 09/575,188 | 09/575,189 | 09/575,162 | 09/575,172 |
| 09/575,170 | 09/575,171 | 09/575,161 | 09/575,141 | 09/575,125 |
| 09/575,142 | 09/575,140 | 09/575,190 | 09/575,138 | 09/575,126 |
| 09/575,127 | 09/575,158 | 09/575,117 | 09/575,147 | 09/575,152 |
| 09/575,176 | 09/575,151 | 09/575,177 | 09/575,175 | 09/575,115 |
| 09/575,114 | 09/575,113 | 09/575,112 | 09/575,111 | 09/575,108 |
| 09/575,109 | 09/575,182 | 09/575,173 | 09/575,194 | 09/575,136 |
| 09/575,119 | 09/575,135 | 09/575,157 | 09/575,166 | 09/575,134 |
| 09/575,121 | 09/575,137 | 09/575,167 | 09/575,120 | 09/575,122 |

The disclosures of these co-pending applications are incorporated herein by cross-reference.

FIELD OF THE INVENTION

This invention relates to a seal within a micro electro-mechanical (MEM) device. The invention has application in ejection nozzles of the type that are fabricated by integrating the technologies applicable to micro electro-mechanical systems (MEMS) and complimentary metal-oxide semiconductor ("CMOS") integrated circuits, and the invention is hereinafter described in the context of that application. However, it will be understood that the invention does have broader application to seals within various types of MEM devices.

BACKGROUND OF THE INVENTION

A high speed page width ink jet printer has recently been developed by the present applicant. This typically employs in the order of 51,200 ink jet nozzles to print on A4 size paper to provide photographic quality image printing at 1,600 dpi. In order to achieve this nozzle density, the nozzles are fabricated by integrating MEMS-CMOS technology and in this context reference may be made to International Patent Application No. PCT/AU00/00338 lodged by the present applicant and entitled "Thermal Actuator".

These high speed page width ink jet printers produce an image on a sheet by causing an actuator arm to move relative to a substrate by forming the actuating arm in part from an electrically resistive material and by applying a current to the arm to effect movement of the arm. The arm is connected to a paddle so that upon movement of the arm the paddle is moved to eject a droplet of ink onto the sheet. In order to eject the droplet of ink the paddle extends into a nozzle chamber which has a nozzle aperture and movement of the paddle causes the droplet to be ejected from the nozzle aperture. It is therefore necessary for the actuator arm and the paddle to move relative to the nozzle chamber in order to effect ejection of the droplet. Also, in view of the need for the actuator arm and paddle to move relative to the nozzle chamber, there is also a need to seal the nozzle chamber where the actuator arm enters the chamber so the ink does not spuriously leak from the chamber during operation of the printer.

SUMMARY OF THE INVENTION

The present invention provides a micro electro-mechanical device comprising;

a fluid chamber for containing a fluid, the fluid chamber having a first chamber wall, the chamber wall having a part circular concave edge portion defining a part circular cavity;

an outlet aperture in the chamber wall for allowing exit of fluid from the chamber;

an actuator aperture defined partly by said edge portion of the chamber wall;

an actuator extending into said chamber through the actuator aperture and being moveable to dispense fluid from the chamber through the outlet aperture;

a second cylindrical wall carried by the actuator and covering at least a part of said actuator aperture, the second cylindrical wall registering in the part circular cavity so that the second cylindrical wall is in closely spaced apart relationship with respect to the part circular edge portion and moveable relative to the edge portion when the actuator moves to dispense fluid from the chamber; and when the actuator moves in the chamber to dispense fluid from the chamber the second wall moves in closely spaced apart relationship with respect to the edge portion so that a meniscus is formed between the edge portion and second wall by fluid within the chamber thereby creating a seal between the edge portion and the second wall.

PREFERRED FEATURES OF THE INVENTION

Preferably the second wall substantially entirely covers the actuator aperture.

Preferably the second wall is provided on a block coupled to the actuator.

Preferably the block is at least part cylindrical in configuration providing said part cylindrical wall on a surface portion of the block.

Preferably the part circular concave edge portion and the cylindrical wall are coaxial with the cylindrical second wall being moveable in the coaxial direction relative to the part circular concave edge portion when the actuator moves to dispense fluid from the chamber.

Preferably the actuator includes an outer arm portion and an inner arm portion, the outer arm portion having an opening and a portion of the block including a flange projecting through said opening to facilitate coupling of the block to the actuator.

Preferably the second wall is spaced from the edge portion of the chamber wall by a distance of less than one micron when the actuator is in a rest position.

Preferably the actuator is coupled to a paddle arranged within the chamber for the ejection of fluid in the form of droplets from the chamber upon movement of the actuator.

Preferably the actuator is supported at one end in a support structure and electrical circuit elements for operation of the device are embodied in CMOS structures within or on the support structure.

Preferably the chamber wall and the block having the second wall are formed by deposition at the same time and wherein the block has an upper surface which is substantially level with the chamber wall when the actuator is in the rest position.

Preferably a lip is formed on the edge portion which extends outwardly of the chamber the second wall also has a lip which extends outwardly of the chamber.

BRIEF DESCRIPTION OF THE DRAWINGS

A preferred embodiment of the invention will be described, by way of example, with reference to the accompanying drawings in which.

DESCRIPTION OF THE PREFERRED EMBODIMENTS

Figure 1:
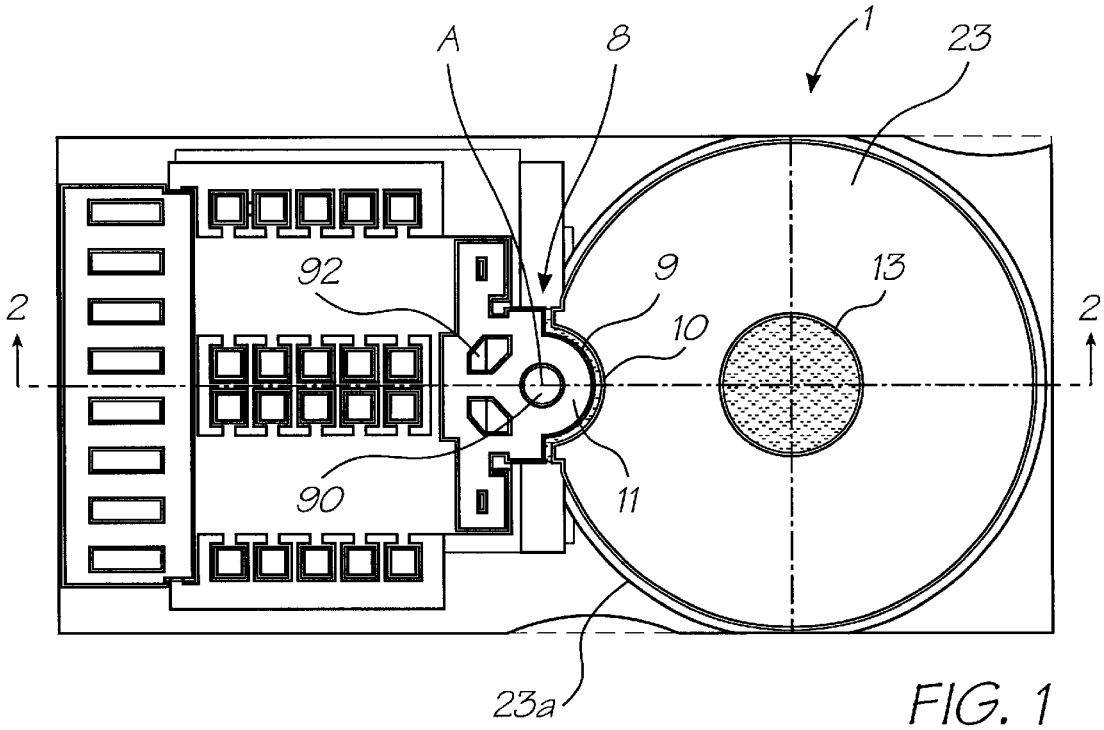
FIG. 1 is a plan view of one embodiment of the invention in an ink jet nozzle for a printer.

As illustrated with approximately 3000× magnification in FIG. 1, and other relevant drawing Figures, a single ink jet nozzle device 1 is shown as a portion of a chip which is fabricated by integrating MEMS and CMOS technologies. The complete nozzle device includes a support structure having a silicon substrate 20, a metal oxide semiconductor layer 21, a passivation layer 22, and a non-corrosive dielectric coating/chamber defining layer 29. Reference may be made to the above identified International Patent Application No. PCT/AU00/00338 for disclosure of the fabrication of the nozzle device. Operation of the device is also more fully disclosed in co-pending application entitled "Movement Sensor In A Micro Electro-mechanical Device" (MJ12) by the same applicant. The contents of these two applications are incorporated into this specification by this reference.

The nozzle device incorporates an ink chamber 24 which is connected to a source (not shown) of ink. The layer 29 forms, amongst other components as will be described hereinafter, a chamber wall 23 which has a nozzle aperture 13 for the ejection of a droplet from ink 25 contained within the chamber 24. As best shown in FIG. 1 the wall 23 is generally cylindrical in configuration with the aperture 13 being provided substantially in the middle of the cylindrical wall 23. The wall 23 has a part circular concave edge portion 10 which forms part of the periphery of the wall 23.

Figure 3:
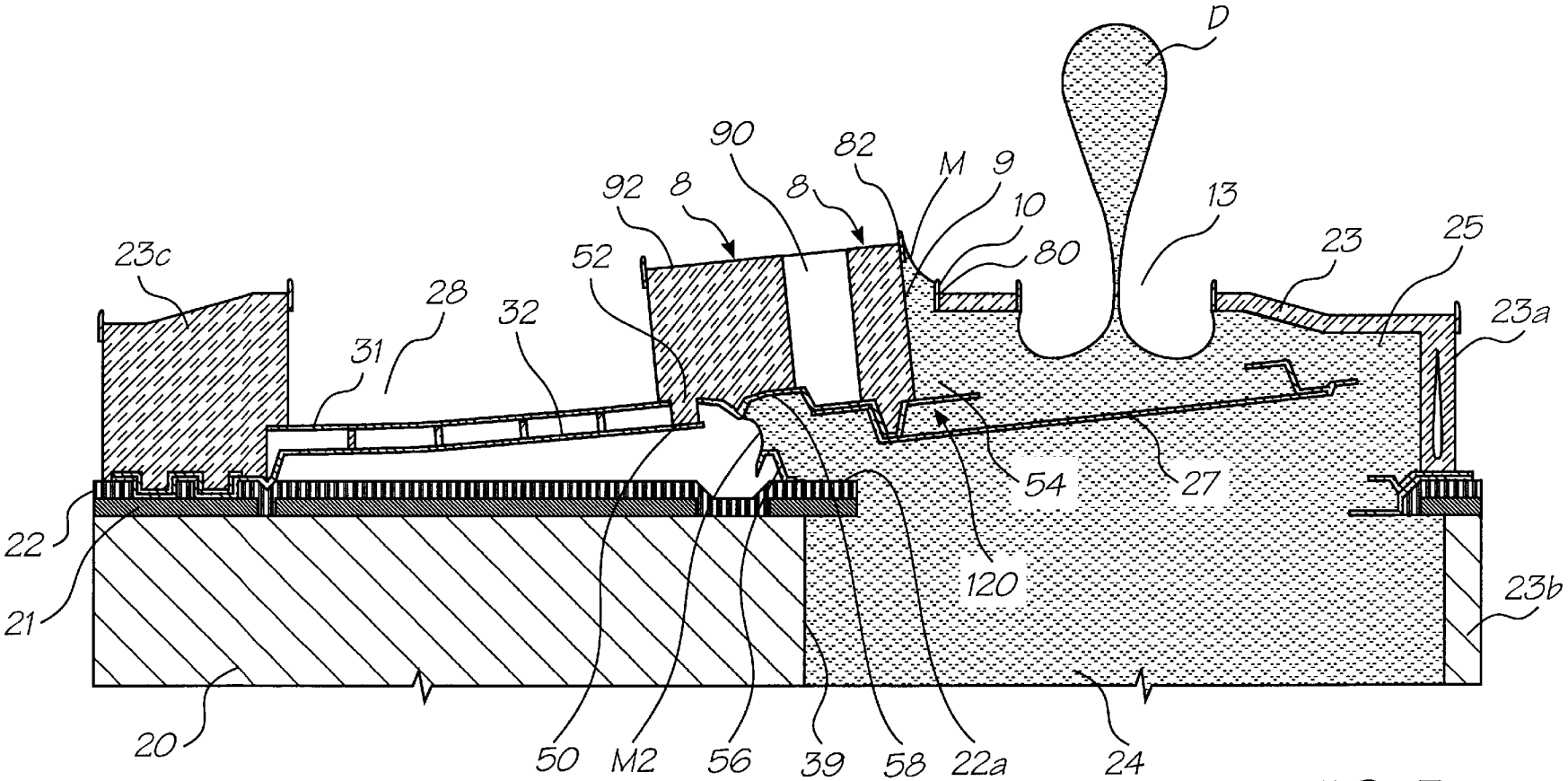
FIG. 3 is a more detailed cross-sectional view similar to FIG. 2 of the preferred embodiment of the invention in an extreme actuated position, showing a drop being ejected from the nozzle.
Figure 4:
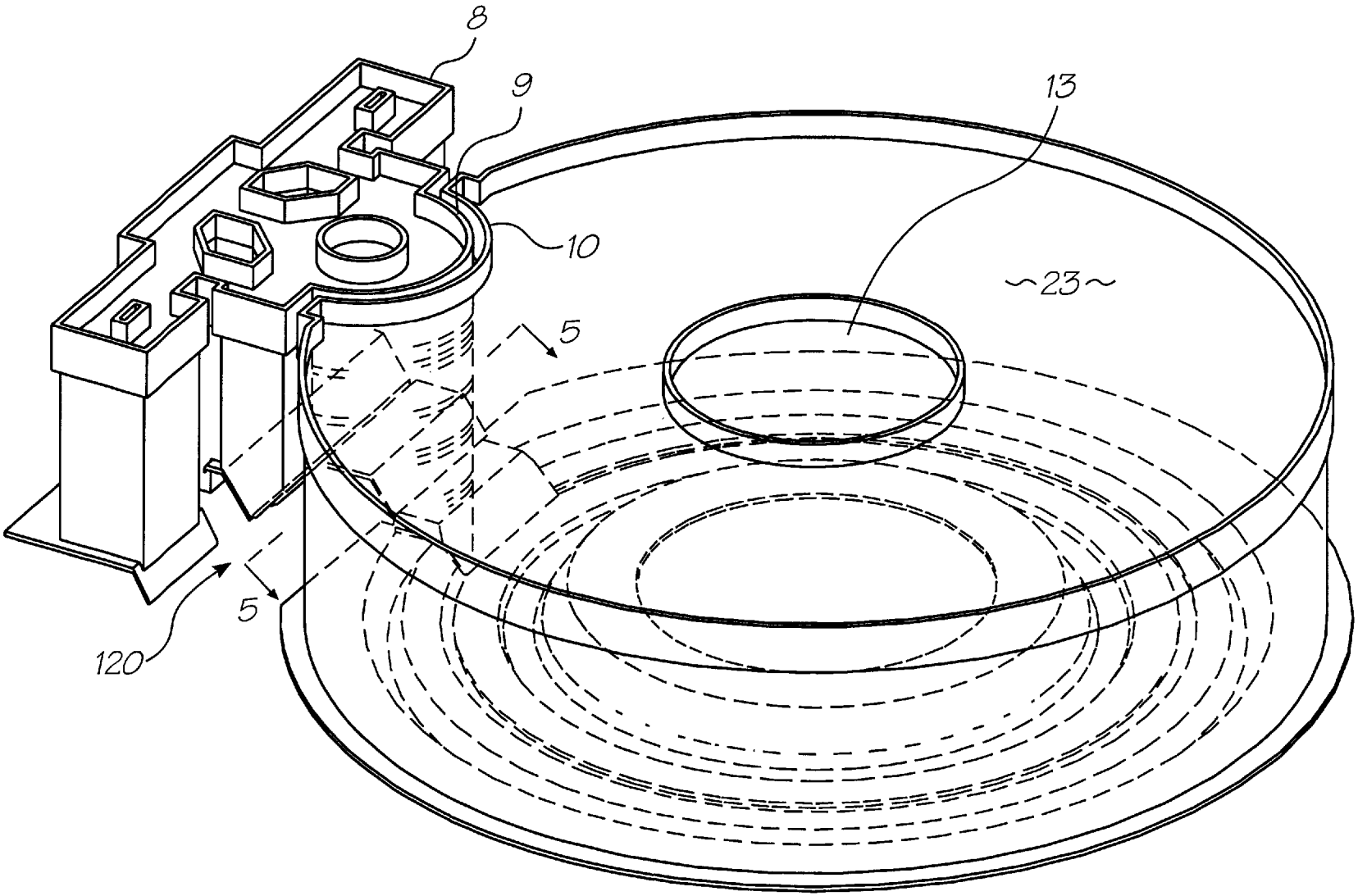
FIG. 4 is a perspective view of a portion of the preferred embodiment shown in FIGS. 1 to 3.

As best seen in FIG. 3, the chamber 24 is also defined by a peripheral side wall 23*a*, a lower side wall 23*b*, a base wall (not shown), and by an edge portion 39 of substrate 20. An actuating arm 28 is formed on layer 22 and support portion 23*c* is formed at one end of the actuating arm 28.

The actuating arm 28 is deposited during fabrication of the device and is pivotable with respect to the substrate 20 and support 23*c*. The actuating arm 28 comprises upper and lower arm portions 31 and 32. Lower portion 32 of the arm 28 is in electrical contact with the CMOS layer 21 for the supply of electrical current to the portion 32 to cause movement of the arm 28, by thermal bending, from the position shown in FIG. 2 to the extreme position shown in FIG. 3 so as to eject droplet D through aperture 13 for deposition on a sheet (not shown). The layer 22 therefore includes the power supply circuitry for supplying current to the portion 32 together with other circuitry for operating the nozzle shown in the drawings as described in the aforesaid co-pending applications.

A block 8 is mounted on the actuator arm 28 and includes a flange portion 50 which extends through an opening 52 in the portion 31 to facilitate securement of the block 8 to the actuator 28. The actuator 28 carries a paddle 27 which is arranged within the chamber 24 and which is moveable with the actuator as shown in FIGS. 1 and 3 to eject the droplet D.

The peripheral wall 23*a*, chamber wall 23, block 8 and support portion 23*c* are all formed by deposition of material which forms the layer 29 and by etching sacrificial material to define the chamber 24, nozzle aperture 13, the discrete block 8 and the space between the block 8 and the support portion 23*c*. The lower wall portion 23*b* is also formed during deposition with the substrate 20.

Figure 2:
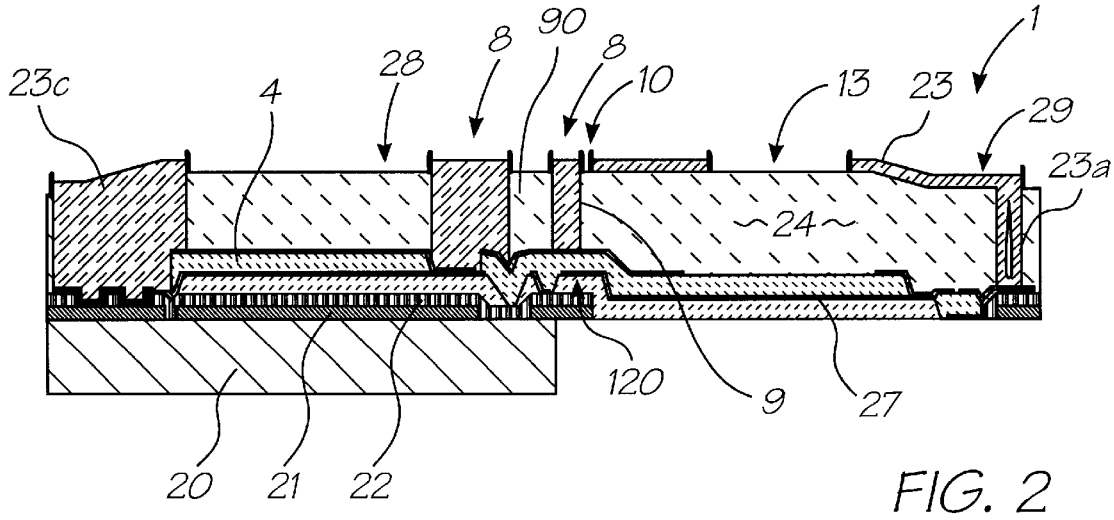
FIG. 2 is a cross-sectional view of the nozzle of FIG. 1 along line 2—2 of FIG. 1.

The space between end edge 22*a* of layer 22 and a part circular edge portion 10 of the wall 23 defines an actuator aperture 54 which is substantially entirely closed by a wall 9 on the block 8, when the actuator 28 is in a rest or quiescent state as shown in FIGS. 1 and 2. In the quiescent position shown in FIGS. 1 and 2, the edge portion 10 of the wall 23 is separated from the wall 9 by a distance of less than one micron so as to define a fine slot between the wall 9 and the edge 10.

The part circular wall portion 10 defines a part circular cavity 11 and the part cylindrical block 8 registers in the cavity 11 so that the cylindrical wall 9 is in closely spaced apart relationship with respect to the edge portion 10. The part circular edge portion 10 and the part circular wall 9 are coaxial about an axis A shown in FIG. 1 which extends into and out of the plane of the paper in FIG. 1. The part cylindrical block 8 may have a central cavity 90 and a box girder structure 92 formed outwardly of the cavity 11. The cavity 90 may be filled with a sacrificial material which is completely encased within the cavity 90 so that it is not etched away during formation of the nozzle. Cavities within the girder structure 92 may also be filled with sacrificial material which is not etched away during formation of the nozzle. The inclusion of the sacrificial material in the cavity 90 and other cavities within the girder structure increases the strength of the block 8.

As the actuator arm 28 moves up and down to eject droplet D from the chamber 24, the planar wall 9 moves up and down relative to edge 10 of the wall 23 whilst maintaining a closely spaced apart relationship with the edge 10 of the wall 23. A meniscus M is formed between the wall 9 and the edge 10 as the wall 9 moves up and down relative to the edge 10 in view of the close proximity of the wall 9 to the edge 10. The maintenance of the meniscus M, forms a seal between edge portion 10 and wall 9, and therefore reduces opportunities for ink leakage and wicking from chamber 24. A meniscus M2 is also formed between support flange 56 formed on the layer 22 and portion 58 of the actuator 28 on which block 8 is formed. When in the quiescent position the portion 58 rests on the flange 54. The formation of the meniscus M2 also reduces opportunities for ink leakage and wicking during movement of the actuating arm 28 and the paddle 27. A meniscus (not shown) is also formed between the sides (not shown) of actuator aperture 54 and the edges (not shown) of wall 23*a* which define the aperture 54.

As shown in FIG. 3, the edge portion 10 may carry a lip 80 and the wall 9 may also carry a lip 82 to further reduce the likelihood of wicking of ink from the chamber 24 onto the block 8 or upper surface of the wall 23. The lip 80 may extend completely about the periphery of the wall 23 and similar lips may also be provided on the aperture 13.

Figure 5:
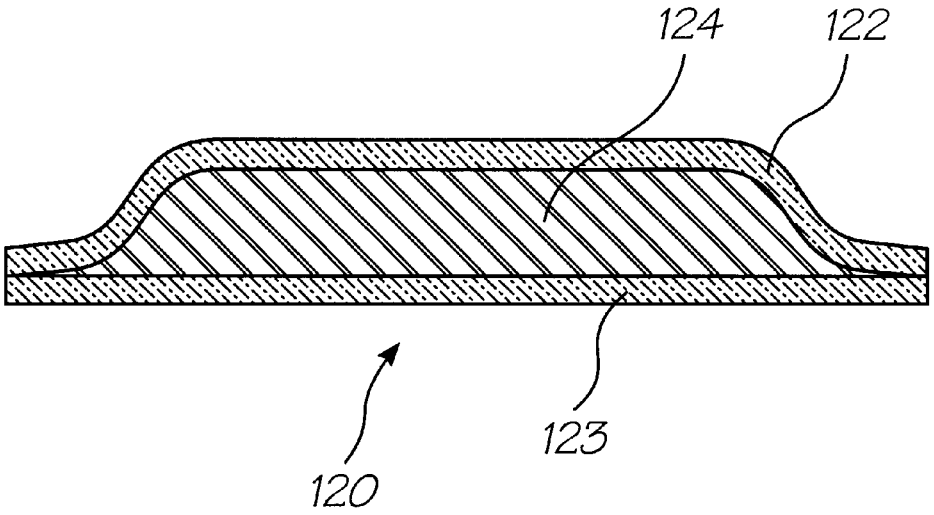
FIG. 5 is a cross-sectional view along the line 5—5 of FIG. 4 according to one embodiment of the invention.
Figure 6:
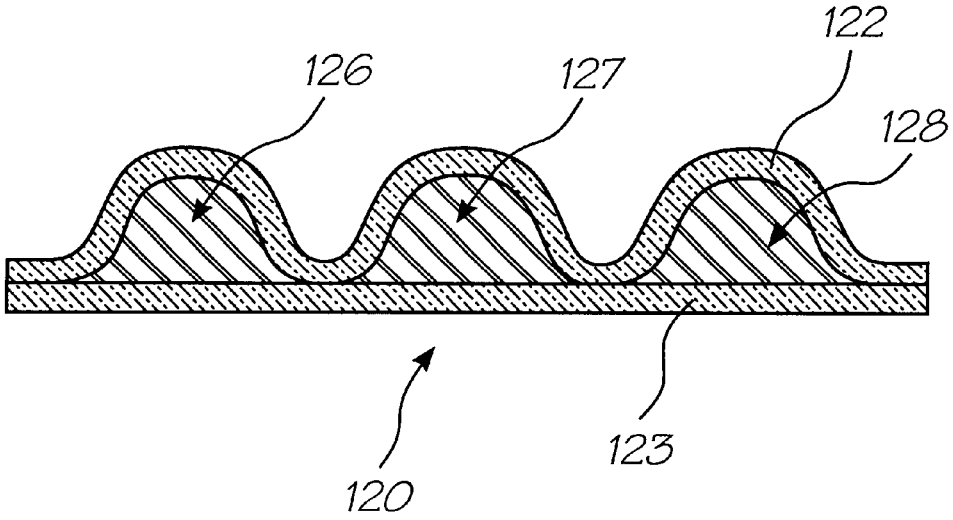
FIG. 6 is a view along the line 5—5 of FIG. 4 according to a further embodiment of the invention.

With reference to FIGS. 5 and 6 the paddle 27 is coupled to the remainder of the actuator arm 28 by a strut portion 120 which extends outwardly from the block 8. The strut portion 120 can include a reinforced structure to strengthen the strut portion 120 and therefore connection of the paddle 27 with the remainder of the actuating arm 28.

FIG. 5 shows one embodiment of the reinforcing structure and in this embodiment the portion 120 is formed from titanium nitrate layers 122 and 123 which surround and enclose a sacrificial material 124. In a second embodiment shown in FIG. 6 the layer 122 is a corrugated layer enclosing sacrificial material 126, 127 and 128. The structures shown in FIGS. 5 and 6 increase the strength of the strut portion 120 connecting the block 8 with the paddle 27.

I claim:

1. A micro electro-mechanical device comprising;

a fluid chamber for containing a fluid, the fluid chamber having a first chamber wall, having a part cylindrical concave edge portion defining a part cylindrical cavity, an outlet aperture in the chamber wall for allowing exit of fluid from the chamber, an actuator aperture defined partly by said edge portion of the chamber wall, an actuator extending into said chamber through the actuator aperture and being moveable to dispense fluid from the chamber through the outlet aperture, a second cylindrical wall carried by the actuator and covering at least a part of said actuator aperture, the second cylindrical wall registering in the part circular cavity so that the second cylindrical wall is in closely spaced apart relationship with respect to the part circular edge portion and moveable relative to the edge portion of the chamber wall when the actuator moves to dispense fluid from the chamber and wherein, when the actuator moves in the chamber to dispense fluid from the chamber, the second wall moves in closely spaced apart relationship with respect to the edge portion so that a meniscus is formed between the edge portion and second wall by fluid within the chamber thereby creating a seal between the edge portion and the second wall.

2. The device of claim 1 wherein the second wall substantially entirely covers the actuator aperture.

3. The device of claim 1 wherein the second wall is provided on a block coupled to the actuator.

4. The device of claim 3 wherein the block is at least part cylindrical in configuration providing said part cylindrical wall on a surface portion of the block.

5. The device of claim 3 wherein the chamber wall and the block having the second wall are formed by deposition at the same time and wherein the block has an upper surface which is substantially level with the chamber wall when the actuator is in the rest position.

6. The device of claim 1 wherein the part circular concave edge portion and the cylindrical wall are coaxial with the cylindrical second wall being moveable in the coaxial direction relative to the part circular concave edge portion when the actuator moves to dispense fluid from the chamber.

7. The device of claim 1 wherein the actuator includes an outer arm portion and an inner arm portion, the outer arm portion having an opening and a portion of the block including a flange projecting through said opening to facilitate coupling of the block to the actuator.

8. The device of claim 1 wherein the second wall is spaced from the edge portion of the chamber wall by a distance of less than one micron when the actuator is in a rest position.

9. The device of claim 1 wherein the actuator is coupled to a paddle arranged within the chamber for the ejection of fluid in the form of droplets from the chamber upon movement of the actuator.

10. The device of claim 1 wherein the actuator is supported at one end in a support structure and electrical circuit elements for operation of the device are embodied in CMOS structures within or on the support structure.

11. The device of claim 1 wherein a lip is formed on the edge portion which extends outwardly of the chamber the second wall also has a lip which extends outwardly of the chamber.

* * * * *